US008297211B2

(12) United States Patent
Stokes et al.

(10) Patent No.: US 8,297,211 B2
(45) Date of Patent: Oct. 30, 2012

(54) METHOD AND APPARATUS FOR INERTIAL STITCH REGULATION

(75) Inventors: Theodore J. Stokes, Lapeer, MI (US); Matthew Paul Sherman, Columbia, MO (US); Kenneth Mark Eubanks, Columbia, MO (US); Paul Truman Statler, Columbia, MO (US); Joseph W. Bauman, Cabool, MO (US)

(73) Assignee: Gammill, Inc., Columbus, OH (US)

( * ) Notice: Subject to any disclaimer, the term of this patent is extended or adjusted under 35 U.S.C. 154(b) by 522 days.

(21) Appl. No.: 12/469,353

(22) Filed: May 20, 2009

(65) Prior Publication Data

US 2010/0294185 A1 Nov. 25, 2010

(51) Int. Cl.
*D05B 21/00* (2006.01)

(52) U.S. Cl. ..... 112/102.5

(58) Field of Classification Search ..... 112/102.5, 112/470.03, 475.02, 475.19, 117–119, 220, 112/470.06, 470.13, 470.18
See application file for complete search history.

(56) References Cited

U.S. PATENT DOCUMENTS

| | | | | |
|---|---|---|---|---|
| 3,967,515 | A | 7/1976 | Nachtigal et al. | |
| 4,108,093 | A * | 8/1978 | Watanabe et al. | 112/458 |
| 4,221,176 | A | 9/1980 | Besore et al. | |
| 4,402,276 | A * | 9/1983 | Steinki et al. | 112/475.05 |
| 4,843,293 | A | 6/1989 | Futami | |
| 4,953,231 | A * | 9/1990 | Burnett | 2/13 |
| 4,984,464 | A | 1/1991 | Thomas et al. | |
| 5,250,880 | A | 10/1993 | Chesney et al. | |
| 5,260,629 | A | 11/1993 | Ioi et al. | |
| 6,178,903 | B1 | 1/2001 | Bondanza et al. | |
| 6,241,435 | B1 | 6/2001 | Huang et al. | |
| 6,314,327 | B1 | 11/2001 | Mugler et al. | |
| 7,130,764 | B2 | 10/2006 | Mugler et al. | |
| 7,143,705 | B2 | 12/2006 | Frazer et al. | |
| 7,191,718 | B1 | 3/2007 | Myers et al. | |
| 7,918,170 | B2 * | 4/2011 | Myers et al. | 112/117 |
| 2002/0104468 | A1 | 8/2002 | Myers et al. | |

OTHER PUBLICATIONS

Analog Devices, High Accuracy, Dual-Axis Digital Inclinometer and Accelerometer, ADIS16209 (2008).

Seifert, et al., Implementing Positioning Algorithms Using Accelerometers, AN3397 Freescale Semiconductor Application Note (2007).

* cited by examiner

*Primary Examiner* — Tajesh Patel
(74) *Attorney, Agent, or Firm* — Husch Blackwell LLP; H. Frederick Rusche

(57) ABSTRACT

A stitcher is provided that includes a needle to stitch a workpiece, a motor to operate the needle, and a stitch regulator in communication with and capable of controlling a speed of the motor. A controller is in communication with the stitch regulator. The stitcher also includes at least one accelerometer in communication with the controller to determine an acceleration of the stitcher with respect to the workpiece. A signal representing the acceleration of the stitcher with respect to the workpiece is utilized to adjust the operation of the needle as necessary.

20 Claims, 2 Drawing Sheets

METHOD AND APPARATUS FOR INERTIAL STITCH REGULATION

FIELD OF THE INVENTION

The present invention relates to long-arm stitchers and, more particularly, to a control system for long-arm stitchers and the like.

RELATED ART

Conventional long-arm sewing machines are generally used for quilting and/or sewing fabrics that are not easily moved through a sewing machine. As such, a long-arm sewing machine is designed to move with respect to a workpiece that is held stationary on a frame. However, the workpieces generally include two outer layers and a filler material that is sewn between the outer layers. Often, the filler being stitched into the workpiece is uneven, thereby adding to difficulties for a stitch regulator to properly control a velocity of the stitcher with respect to the workpiece. Moreover, the stitch design of the workpiece may include several different stitch types and/or a stitch pattern that is not straight, thereby complicating the ability to control the stitch pattern. Accordingly, the velocity of stitcher movement with respect to the workpiece must be varied during stitching to maintain a proper stitch length or number of stitches per inch of the workpiece.

Typically, a stitch regulator is controlled by optical encoders that monitor the stitch pattern as it is being stitch into the workpiece. However, such encoders must be positioned adjacent the workpiece and may resultantly interfere with the stitching operation. In addition, optical encoders are costly and require a significant amount of assembly time. The assembly also generally includes harnesses and cabling to properly install the optical encoder.

As such, it is desirable to control a stitch regulator utilizing a less costly and more easily assembled system that does not interfere with the stitching process.

SUMMARY OF THE INVENTION

In one embodiment, a control system for a stitcher is provided that includes a motor driving the stitcher, and a stitch regulator in communication with and capable of altering a velocity of the motor. A controller is in communication with the stitch regulator; and at least one accelerometer is in communication with the controller to determine an acceleration of the stitcher with respect to a workpiece. A signal representing the acceleration of the stitcher with respect to the workpiece is communicated to the controller; and the operation of the stitch regulator is modified as necessary based on the signal.

In another embodiment, a stitcher is provided that includes a needle to stitch a workpiece, a motor to operate the needle, and a stitch regulator in communication with and capable of controlling a speed of the motor. A controller is in communication with the stitch regulator. The stitcher also includes at least one accelerometer in communication with the controller to determine an acceleration of the stitcher with respect to the workpiece. A signal representing the acceleration of the stitcher with respect to the workpiece is utilized to adjust the operation of the needle as necessary.

In a further embodiment a method of operating a stitcher is provided. The method includes providing a stitch regulator for controlling the operation of the stitcher, and providing an accelerometer in communication with the stitch regulator. An acceleration of the stitcher with respect to a workpiece is measured with the accelerometer, and a signal representing the acceleration of the stitcher is sent to the stitch regulator. The method further includes integrating the signal representing the acceleration of the stitcher to determine a velocity of the stitcher with respect to the workpiece, and controlling the stitch regulator utilizing the velocity of the stitcher with respect to the workpiece.

Although the present invention is described with respect to a long-arm stitcher, one of ordinary skill in the art would recognize that the present invention also has applicability with standard sewing machines and could be used in both a commercial and/or household setting. Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
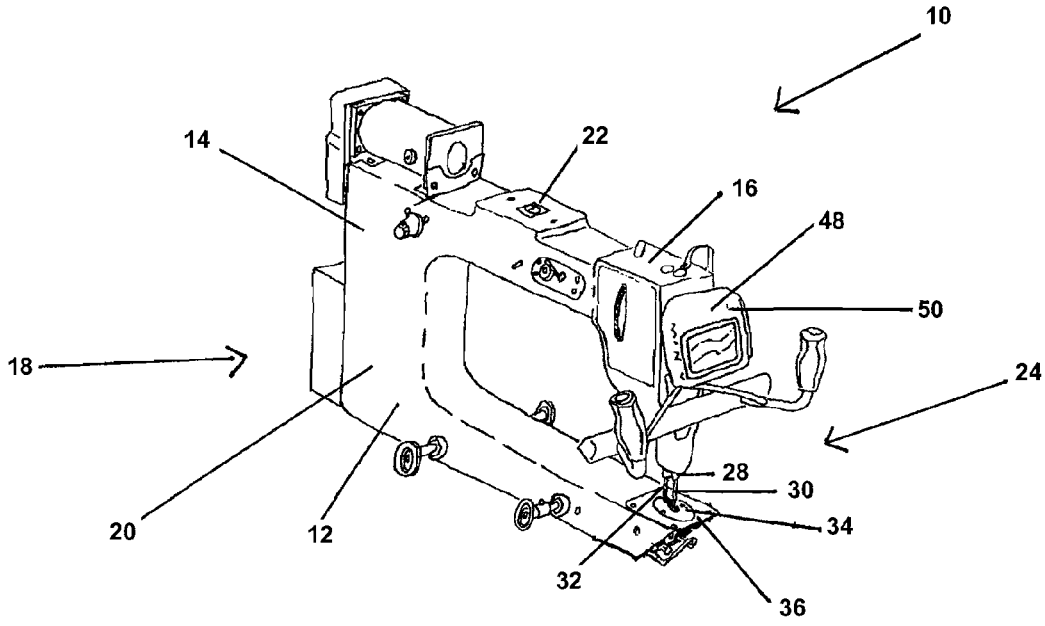
FIG. 1 (PRIOR ART)
FIG. 1 is a perspective view of a prior art long-arm stitcher.

FIG. 1 illustrates a standard long-arm stitcher 10 including a base 12, an arm 14, and a take up lever box 16. Although the present invention is described with respect to a long-arm stitcher, one of ordinary skill in the art would recognize that the present invention is also applicable to standard sewing machines. Moreover, the present invention is capable of operating with both commercial and household long-arm stitchers and sewing machines. The arm 14 is coupled to the base 12 at a back end 18 of the stitcher 10. A first portion 20 of the arm 14 extends upward from the base 12, and a second portion 22 of the arm 14 extends from the first portion 20 substantially parallel to the base 12. The take up lever box 16 is disposed on the arm 14 at a stitching end 24 of the stitcher 10 that is opposite the back end 18. The stitching end 24 of the stitcher 10 forms a workspace 26 where a fabric is stitched by an operator of the stitcher 10. The stitching end includes a needle bar 28 having a needle 30 inserted therein and a hopping foot 32 each extending downward toward a needle plate 34 disposed on the base 12. The needle plate 34 is attached to a square throat plate 36. The throat plate 36 is configured to be removed to provide access to a rotary hook assembly (not shown) positioned within the base 12 below the throat plate 36.

During operation, the needle bar 28 moves up and down thereby moving the needle 30 to form a stitch in the fabric. The needle bar 28 can be adjusted up or down to provide a proper machine timing height. A small hole in the needle plate 34 restricts movement of the thread as the stitch is formed. The hopping foot 32 raises and lowers with the movement of the needle 30 to press and release the fabric as the stitch is formed. The hopping foot 32 is designed to be used with rulers and templates and has a height that can be adjusted for proper stitch formation. A control box 48 is provided to control the operation of the stitcher 10.

The control box 48 includes a stitch regulator 50 that controls a speed of the needle 30. Specifically, the needle speed is controlled to accommodate varying thicknesses of the workpiece and varying stitch types. The speed is further controlled to accommodate a stitch pattern that may not be linear.

Figure 2:
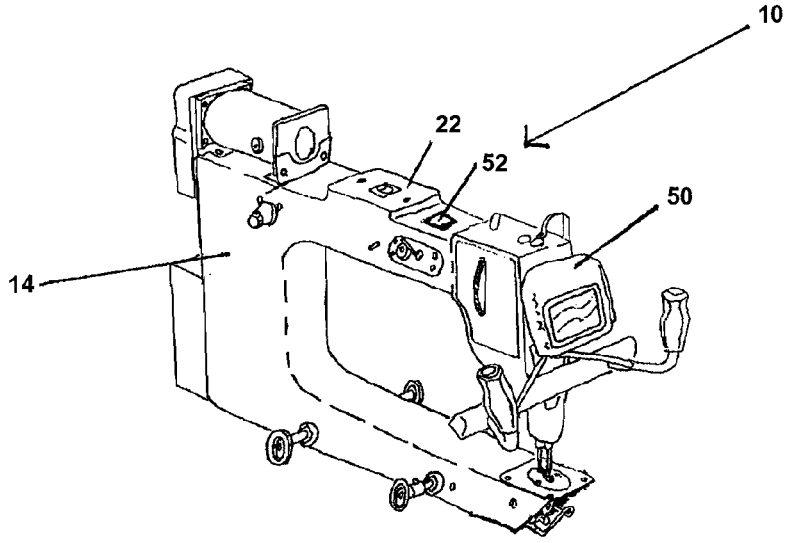
FIG. 2 is a perspective view of the stitcher shown in FIG. 1 having an accelerometer.

FIG. 2 illustrates the stitcher 10 having at least one accelerometer 52 positioned on the second portion 22 of the arm 14 to measure an acceleration of the stitcher 10. As will be appreciated by one of ordinary skill in the art, the at least one accelerometer 52 may be positioned at any location on stitcher 10. In one embodiment, the accelerometer 52 measures a piezoelectric effect utilizing microscopic crystal structures that become stressed by accelerative forces, thereby causing a voltage to be generated. The voltage is used then used to determine acceleration. Alternatively, the accelerometer 52 may sense changes in capacitance between two microstructures in the accelerometer 52. Specifically, if an accelerative force moves one of the structures, the capacitance changes. The change in capacitance is then converted to a voltage that is used to determine acceleration. In other embodiments, the accelerometer 52 may utilize hot air bubbles or light. In the exemplary embodiment, the at least one accelerometer 52 is one of a single two-axis accelerometer or includes two separate accelerometers, namely an x-axis accelerometer and a y-axis accelerometer. Accordingly, the accelerometer 52 is capable of measuring the acceleration of stitcher 10 in any of the x-axis and the y-axis. In the exemplary embodiment, the accelerometer 52 is a high accuracy, dual-axis digital inclinometer and accelerometer, model number ADIS16209, from Analog Devices; however, it will be appreciated that any off-the-shelf accelerometer would be acceptable for use with the stitcher 10.

Figure 3:
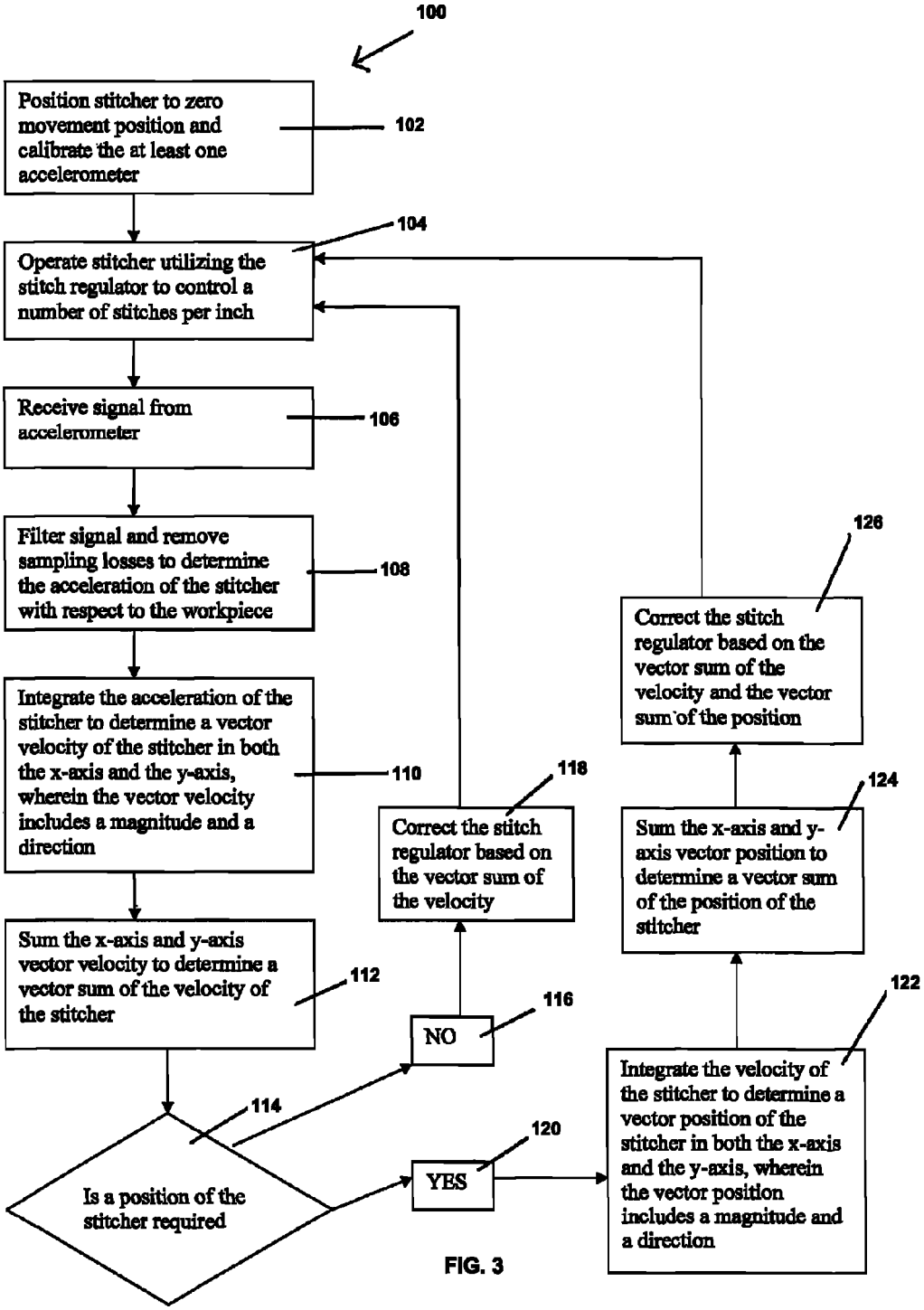
FIG. 3 is an algorithm of a method of operating the stitcher shown in FIG. 2.

The accelerometer 52 is electronically coupled to the stitch regulator 50 and is configured to control the stitch regulator 50 based on the algorithm 100 shown in FIG. 3. Specifically, at step 102, the stitcher 10 is moved to a zero motion position and the accelerometer 52 is calibrated while the stitcher 10 is stationary. The stitcher 10 is then operated, at step 104, to stitch a pattern in the workpiece. During the operation, the stitch regulator 50 controls a number of stitches per inch that are stitched into the workpiece.

At step 106, a signal indicative of the stitcher's acceleration with respect to the workpiece is received from the accelerometer 52. The signal is filtered with a low pass filter and sampling losses are removed therefrom, at step 108, to determine an acceleration of the stitcher 10 in both the x-axis and the y-axis. While the present invention is described with respect to both the x-axis and the y-axis, as will be appreciated by one of ordinary skill in the art, the signal may only be indicative of the stitcher's acceleration in one of the x-axis or the y-axis. At step 110, the acceleration signal is integrated to provide a vector velocity of the stitcher 10 in the x-axis and the y-axis, wherein the vector velocities include both a magnitude and a direction. The vector velocity in the x-axis and the vector velocity in the y-axis are summed, at step 112, to provide a vector sum having both a magnitude and direction indicative of a velocity of the stitcher 10 with respect to the workpiece.

At step 114, it is determined whether a position of the stitcher 10 is also desired. If the position is not desired 116, the velocity of the stitcher 10 is used to determine a correction of the stitch regulator 50, at step 118. The stitcher 10 is then operated, at step 104, to stitch a pattern in the workpiece, wherein the stitch regulator 50 controls the number of stitches per inch based on the velocity correction.

If the position of the stitcher 10 is desired 120, the stitcher velocity is integrated, at step 122, to provide a vector position of the stitcher 10 in the x-axis and the y-axis, wherein the vector positions include both a magnitude and a direction. The vector position in the x-axis and the vector position in the y-axis are summed, at step 124, to provide a vector sum having both a magnitude and direction indicative of a position of the stitcher 10 with respect to the workpiece. The velocity and position of the stitcher 10 is then used to determine a correction of the stitch regulator 50, at step 126. The stitcher 10 is then operated, at step 104, to stitch a pattern in the workpiece, wherein the stitch regulator 50 controls the number of stitches per inch based on the velocity and position corrections.

Accordingly, the present invention provides a means to regulate a speed of stitcher needle 30 utilizing the acceleration and position of the stitcher in the x-axis and/or y-axis. Specifically, by determining the acceleration of the stitcher 10, a velocity and displacement of the stitcher 10 is determined and input into the stitch regulator 50. As such, the needle 30 can be regulated based on a velocity and/or displacement of the stitcher 10 with respect to a workpiece, thereby enabling automatic correction of a stitch pattern.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A control system for a stitcher, said control system comprising:

a motor driving the stitcher;

a stitch regulator in communication with and capable of altering a velocity of said motor;

a controller in communication with said stitch regulator; and at least one accelerometer in communication with said controller to determine an acceleration of the stitcher with respect to a workpiece, wherein a signal representing the acceleration of the stitcher with respect to the workpiece is communicated to said controller, and wherein the operation of said stitch regulator is modified as necessary based on said signal.

2. The control system according to claim 1, wherein said controller is capable of integrating said signal representing the acceleration of the stitcher to determine a magnitude and direction of a velocity of the stitcher with respect to the workpiece, wherein the operation of said stitch regulator is modified as necessary based on said magnitude and direction of the velocity of the stitcher.

3. The control system according to claim 1, wherein modification of the operation of said stitch regulator controls a number of stitches per inch formed in the workpiece.

4. The control system according to claim 1, wherein said at least one accelerometer comprises a two-axis accelerometer to determine an acceleration of the stitcher in the x-axis and the y-axis.

5. The control system according to claim 1, wherein said at least one accelerometer comprises an x-axis accelerometer and a y-axis accelerometer to determine an acceleration of the stitcher in the x-axis and the y-axis.

6. The control system according to claim 1, wherein the acceleration of the stitcher is determined in both the x-axis and the y-axis, wherein said controller is capable of integrating a signal representing the acceleration of the stitcher in the x-axis and a signal representing the acceleration of the stitcher in the y-axis to determine a magnitude and direction of the velocity of the stitcher in both the x-axis and the y-axis, the magnitude and direction of the velocity of the stitcher in the x-axis and the y-axis summed to determine a magnitude and direction of a vector sum of the velocity of the stitcher, wherein the operation of said stitch regulator is modified as necessary based on the vector sum of the velocity of the stitcher.

7. The control system according to claim 6, wherein said controller is capable of integrating the velocity of the stitcher in the x-axis and the velocity of the stitcher in the y-axis to determine a magnitude and direction of a position of the stitcher in both the x-axis and the y-axis, the magnitude and direction of the position of the stitcher in the x-axis and the y-axis summed to determine a magnitude and direction of a vector sum of the position of the stitcher, wherein the operation of said stitch regulator is modified as necessary based on the vector sum of the position of the stitcher.

8. A stitcher comprising:

a needle to stitch a workpiece;

a motor to operate said needle;

a stitch regulator in communication with and capable of controlling a speed of said motor;

a controller in communication with said stitch regulator; and at least one accelerometer in communication with said controller to determine an acceleration of said stitcher with respect to the workpiece, wherein a signal representing the acceleration of said stitcher with respect to the workpiece is utilized to adjust the operation of said needle as necessary.

9. The stitcher according to claim 8, wherein said controller is capable of integrating the signal representing the acceleration of said stitcher to determine a magnitude and direction of a velocity of the stitcher with respect to the workpiece, the magnitude and direction of the velocity of the stitcher utilized to adjust the operation of said needle as necessary.

10. The stitcher according to claim 8, wherein said stitch regulator controls a speed of said motor to control a number of stitches per inch formed in the workpiece.

11. The stitcher according to claim 8, wherein said at least one accelerometer comprises a two-axis accelerometer to determine an acceleration of said stitcher in the x-axis and the y-axis.

12. The stitcher according to claim 11, wherein said controller is capable of integrating a signal representing the acceleration of said stitcher in the x-axis and a signal representing the acceleration of the stitcher in the y-axis to determine a magnitude and direction of the velocity of said stitcher in the x-axis and the y-axis, the magnitude and direction of the velocity of said stitcher in the x-axis and the y-axis summed to determine a magnitude and direction of a vector sum of the velocity of said stitcher, the vector sum of the velocity of said stitcher utilized to adjust the operation of said needle as necessary.

13. The stitcher according to claim 8, wherein said at least one accelerometer comprises:

an x-axis accelerometer to determine an acceleration of said stitcher in the x-axis; and a y-axis accelerometer to determine an acceleration of said stitcher in the y-axis.

14. The stitcher according to claim 13, wherein said controller is capable of integrating a signal representing the acceleration of said stitcher in the x-axis and a signal representing the acceleration of said stitcher in the y-axis to determine a magnitude and direction of the velocity of said stitcher in the x-axis and the y-axis, the magnitude and direction of the velocity of said stitcher in the x-axis and the y-axis summed to determine a magnitude and direction of a vector sum of the velocity of said stitcher, the vector sum of the velocity of said stitcher utilized to adjust the operation of said needle as necessary.

15. The stitcher according to claim 8, wherein said stitcher is one of a long-arm stitcher and a standard sewing machine.

16. The stitcher according to claim 8, wherein said stitcher is configured for at least one of household use and commercial use.

17. A method of operating a stitcher, said method comprising:

providing a stitch regulator for controlling the operation of the stitcher;

providing an accelerometer in communication with the stitch regulator;

measuring an acceleration of the stitcher with respect to a workpiece with the accelerometer;

sending a signal representing the acceleration of the stitcher to the stitch regulator;

integrating the signal representing the acceleration of the stitcher to determine a velocity of the stitcher with respect to the workpiece; and controlling the stitch regulator utilizing the velocity of the stitcher with respect to the workpiece.

18. The method according to claim 17, wherein said measuring an acceleration of the stitcher further comprises measuring an acceleration of the stitcher utilizing at least one of a two-axis accelerometer and a combination of an x-axis accelerometer and a y-axis accelerometer to determine an acceleration of the stitcher in both the x-axis and the y-axis.

19. The method according to claim 18 further comprising:

integrating a signal representing the acceleration of the stitcher in the x-axis and a signal representing the acceleration of the stitcher y-axis to determine a magnitude and direction of the velocity of the stitcher in the x-axis and the y-axis; and summing the magnitude and direction of the velocity of the stitcher in the x-axis and the y-axis to determine a magnitude and direction of a vector sum of the velocity of the stitcher;

controlling the stitch regulator based on the vector sum of the velocity of the stitcher.

20. The method according to claim 19 further comprising:

integrating the velocity of the stitcher in the x-axis and the velocity of the stitcher in the y-axis to determine a magnitude and direction of a position of the stitcher in the x-axis and the y-axis;

summing the magnitude and direction of the position of the stitcher in the x-axis and the y-axis to determine a magnitude and direction of a vector sum of the position of the stitcher with respect to the workpiece; and controlling the stitch regulator based on the vector sum of the position of the stitcher.

* * * * *